United States Patent [19]

Lichtman

[11] 4,342,169

[45] Aug. 3, 1982

[54] MANUALLY CYCLED PISTOL

[75] Inventor: Philip R. Lichtman, Newton, Mass.

[73] Assignee: Nicholas A. Pandiscio, Wayland, Mass. ; a part interest

[21] Appl. No.: 165,640

[22] Filed: Jul. 2, 1980

Related U.S. Application Data

[60] Continuation of Ser. No. 3,373, Jan. 15, 1979, abandoned, which is a continuation of Ser. No. 851,451, Nov. 14, 1977, abandoned, which is a division of Ser. No. 699,083, Jun. 23, 1976, abandoned.

[51] Int. Cl.[3] ..... F41C 3/00

[52] U.S. Cl. ..... 42/11

[58] Field of Search ..... 42/7, 10, 11, 70 C; 89/147, 161, 163

[56] References Cited

U.S. PATENT DOCUMENTS

| | | | |
|---|---|---|---|
| 918,380 | 4/1909 | Schwarzlose | 89/161 |
| 1,226,478 | 5/1917 | Diehm | 42/7 |
| 1,519,806 | 12/1924 | Wesson | 42/11 |
| 4,031,648 | 6/1977 | Thomas | 89/147 |

*Primary Examiner*—Stephen C. Bentley

*Attorney, Agent, or Firm*—Schiller & Pandiscio

[57] ABSTRACT

A pistol design is provided which makes it possible to make a small sized pistol for firing relatively large size cartridges, e.g. a .45 pistol. The pistol is manually cycled for reloading and is characterized by a barrel which must be moved forward to remove a spent case and backward to chamber a new cartridge, and novel means for (a) firing the weapon, (b) preventing accidental discharge of the weapon, and (c) preventing forward movement of the barrel when the trigger is pulled.

5 Claims, 20 Drawing Figures

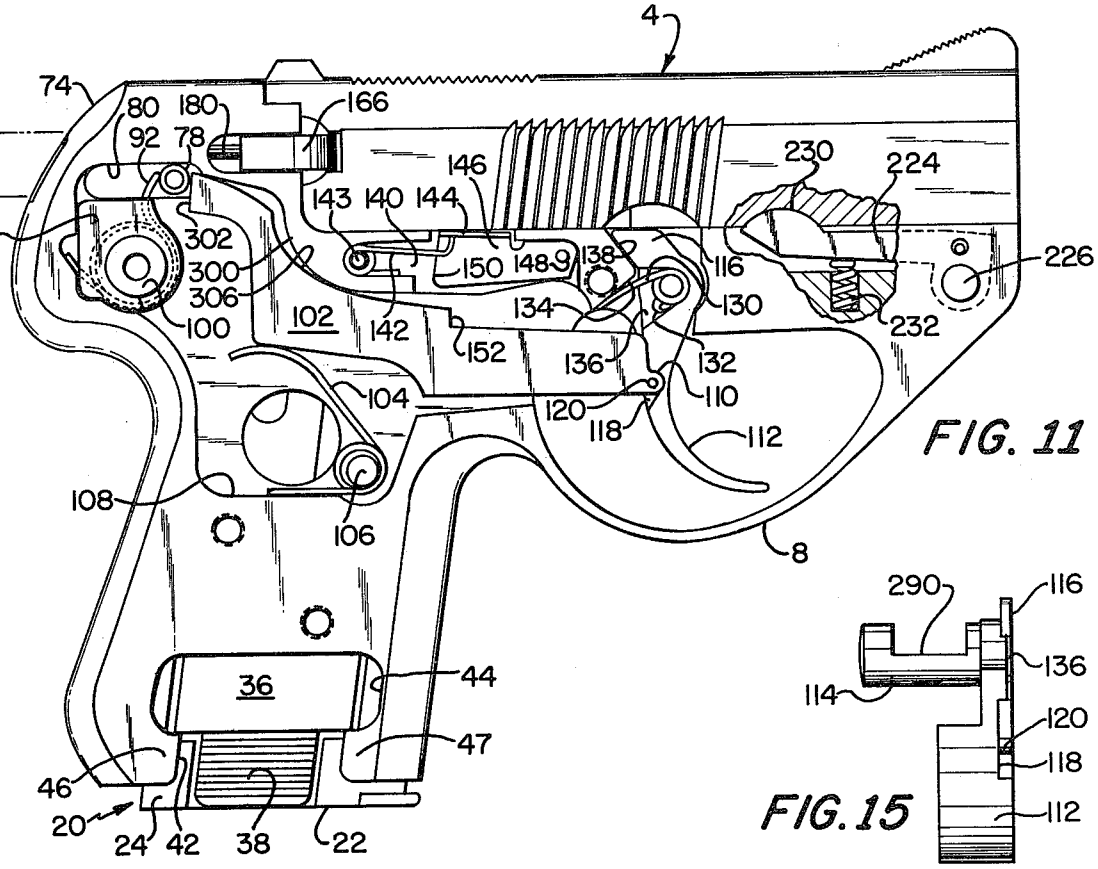
FIG. 11
FIG. 15
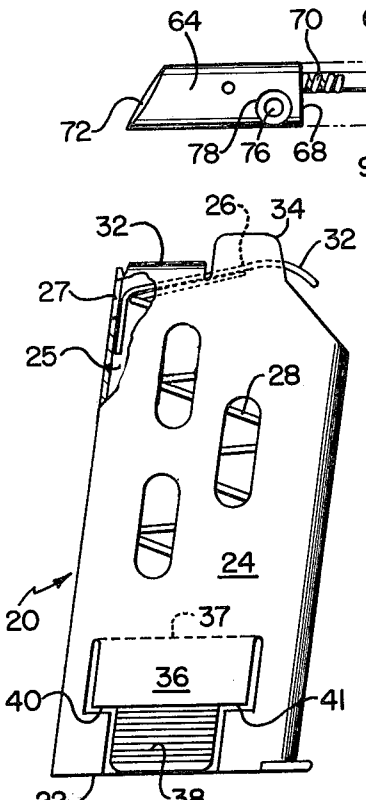
FIG. 10

MANUALLY CYCLED PISTOL

This application is a continuation of my copending application Ser. No. 003,373, filed Jan. 15, 1979, now abandoned, for Manually Cycled Pistol, which application is a continuation of my prior application Ser. No. 851,451, filed Nov. 14, 1977, now abandoned which application is a division of my application Ser. No. 699,083, filed June 23, 1976, now abandoned.

This invention relates to firearms and more particularly to a pistol of novel and improved structure.

The primary object of this invention is to provide a pistol which combines the advantages of small size and relatively large fire power. Another object is to provide a sidearm which is especially suitable as a concealable defensive sidearm. Still another object is to provide a pistol which is relatively light weight, simple in construction, reliable, and compact. A more specific object is to provide a multi-shot .45 pistol which not only weighs less and is smaller than other known pistols of the same cartridge size but is actually smaller than and weighs less than the best known .380 pistols of the type which are classified as concealable handguns, e.g. a Walther PPK .380. Still another object is to provide a repeating pistol which is manually fed and easily field stripped and adapted for use with a silencer. A further specific object is to provide a novel firing mechanism.

These objects and other objects hereinafter stated or rendered obvious are achieved by providing a manually-cycled repeating pistol which is similar to the Schwarzlose "blowforward" design to the extent that it comprises a barrel assembly which is moved forward for cartridge ejection and feeding. However, unlike the Schwarzlose design, the barrel is locked in place on firing, so that the pistol is fired from a locked breech. The pistol comprises (1) means for freezing a cartridge in the feed position and preventing its accidental dislodgment from the breech in the event the weapon is canted while the barrel is out of battery position (2) means for locking the barrel during firing and unlocking the barrel when the trigger is released, (3) a striker-type firing mechanism, and (4) a novel magazine release. Still other features and advantages of the invention are described or rendered obvious by the following detailed descriptions of a preferred embodiment of the invention which is to be considered together with the drawings wherein:

FIG. 10 is an elevational view of the magazine;

FIG. 11 is an elevational view of the pistol with certain parts removed or in section;

FIG. 15 is a rear view in elevation of the trigger unit;

Figure 3:
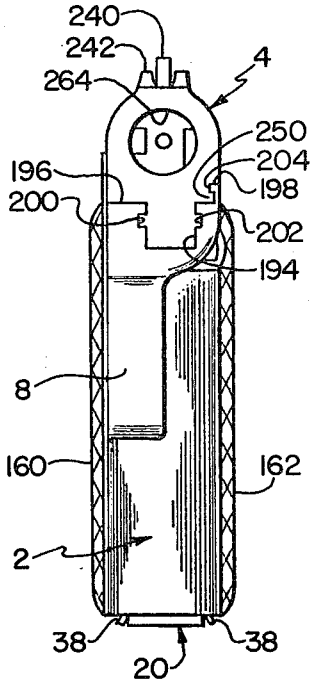
FIGS. 2 and 3 are rear and front elevations of the same pistol.

Turning now to FIGS. 1–8 and 10, the illustrated pistol comprises a metal frame 2 which slideably supports a metal barrel assembly 4. As seen best in FIGS. 7 and 8, frame 2 is one piece and is formed with a top barrel mounting section 6, a trigger guard 8, a handle or grip section 10 and a top rear striker-mounting section 12. Grip section 10 is hollow and comprises opposite side walls 14 and 16 which are joined at the front and back and define the sides of a cavity 18 for receiving a hollow magazine 20 which contains a predetermined number of cartridges 30 (FIG. 9). Magazine 20 comprises a closed bottom wall 22 and right and left hand side walls 24 and 25. Mounted within the magazine is a slidable cartridge pressure plate 26 and a compression spring 28 which engages bottom wall 22 and causes pressure plate 26 to force the cartridges upwardly. The upper ends of magazine side walls 24 and 25 are formed with like inwardly curved lips 32 which prevent pressure plate 26 from being forced out of the magazine by spring 28 when the magazine is empty and whose primary function is to engage and slidably retain the topmost cartridge in the magazine. The forward end of pressure plate 26 is curved downwardly as shown at 32 to avoid interference with tail 276 of the barrel assembly. The upper end of the magazine's right hand side wall 24 also is formed with an extension in the form of a flat tongue 34 which functions to prevent a cartridge from falling out of the pistol in the event the pistol is tilted so that its right side faces down when the barrel is moved out of battery position, i.e. when the breech is opened.

Magazine 20 is releasably secured within grip section 10 by a novel manually releasable, snap-type interlock. As seen in FIGS. 1–4 and 7–11, a portion of each magazine side wall 24 and 25 is punched out so as to provide a detent tongue 36 with a knurled or ribbed tab 38 at its free end. Magazine 20 is made of spring steel and tongues 36 are formed so that at their upper ends they are bent with respect to side walls 24 and 25 substantially along a line as shown at 37, whereby the bottom ends of the two tongues are spaced from rather than being flush with walls 24 and 25. Each tongue 36 has straight bottom edge sections 40 and 41. Side walls 14 and 16 of the frame are formed with slots 42 at their bottom ends to accommodate tabs 38. These slots are wider than tabs 38 and have enlarged sections 44 at their upper ends which are wider than tongues 36. As a consequence of the shape of slots 42, each wall 14 and 16 has a pair of catch sections 46 and 47 with straight edges 48 and 49 respectively that are disposed to interlock with tongues 36. When the magazine is inserted into grip section 10, the tongues 36 engage and are cammed inwardly by the inner surfaces of catch sections 46 and 46, and as the magazine reaches its fully inserted position, the straight edges 40 and 41 clear catch sections 46 and 47 respectively, whereupon tongues 46 spring outwardly far enough for straight edges 40 and 41 to be co-planar with walls 14 and 16 and blocked against withdrawal by straight edges 48 and 49 of catch sections 46 and 47 respectively. This locking occurs as a snap-type action when the magazine is inserted. Removal of the magazine is achieved by squeezing tabs 38 toward one another far enough so that catch sections 46 and 47 cannot interfere with tongues 36, whereby the magazine can be withdrawn with each tongue 36 sliding down behind the adjacent pair of catch sections 46 and 47.

Figure 7:
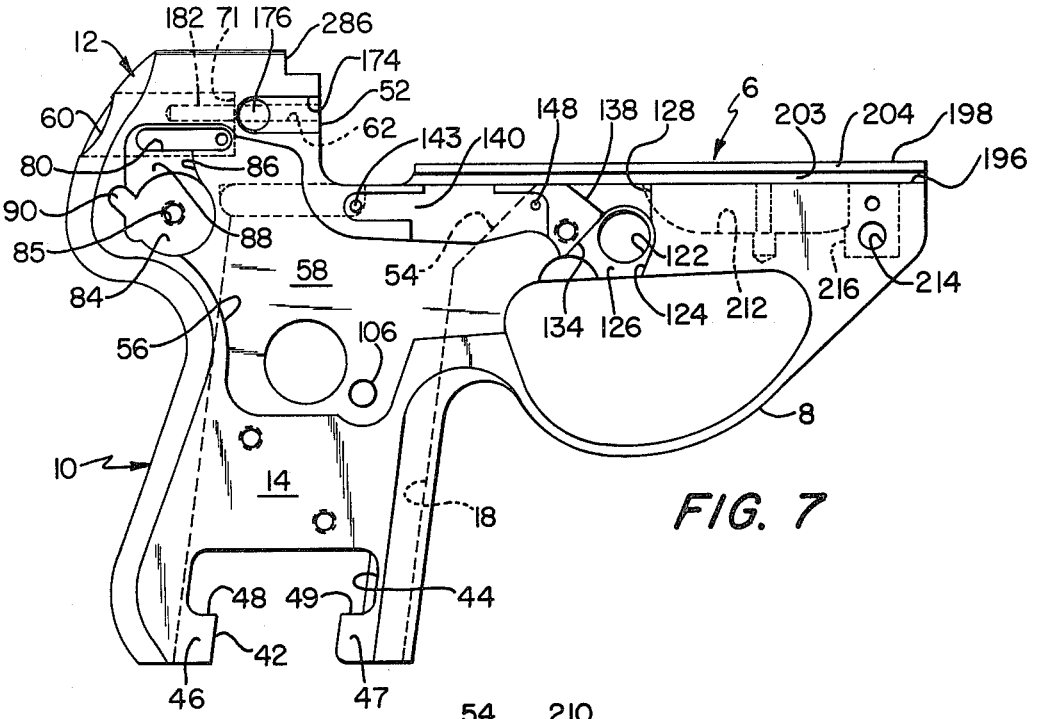
FIGS. 7 and 8 are right and left hand elevational views of the frame.
Figure 8:
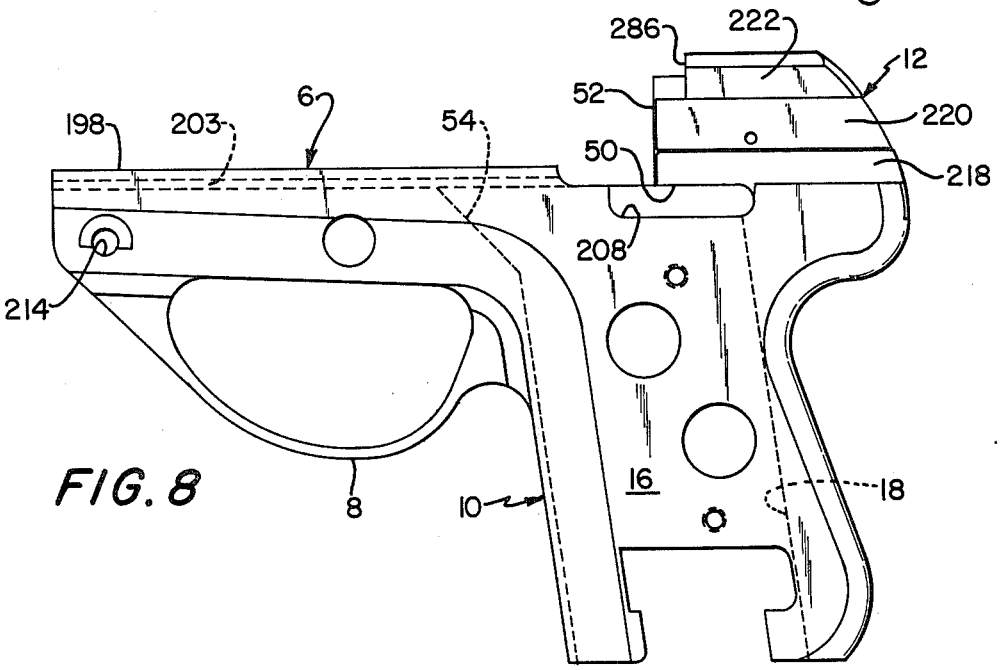
Figure 9:
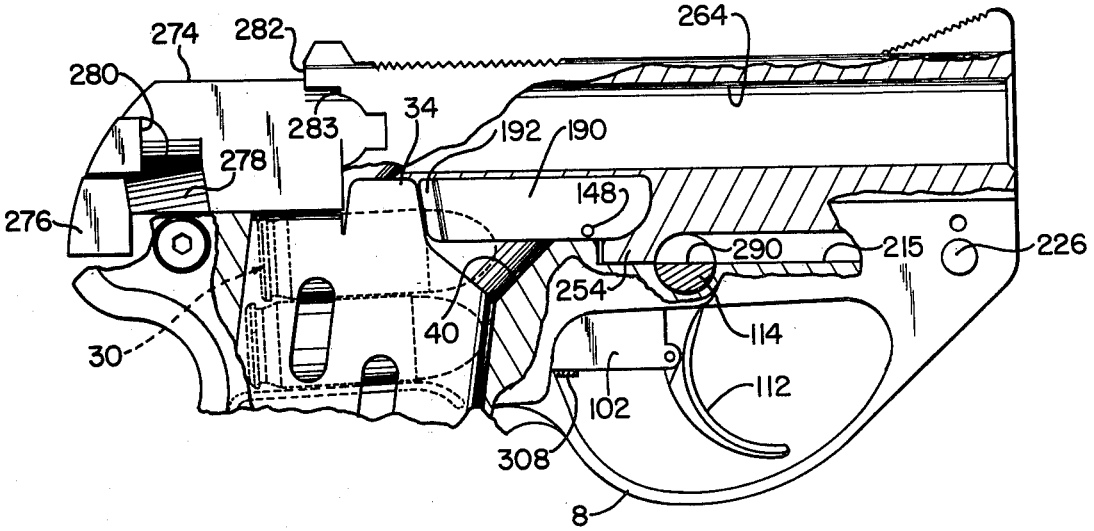
FIG. 9 is a fragmentary view in elevation, with certain parts shown in section, of the same pistol.

Referring now to FIGS. 7–9, striker-mounting section 12 of the frame is characterized by a flat bottom end surface 50 which projects over the upper end of magazine-receiving cavity 18 and acts to help guide the topmost cartridge in the magazine as it is fed forward for introduction into the chamber. The forward end of striker-mounting section 12 also is formed with a flat breech face 52. Still referring to FIGS. 7–9, the interior of the frame is formed with an inclined ramp 54 with a curved cross-section of constant radius. Ramp 54 supports and positions the topmost cartridge from the magazine so that it will be chambered when the barrel is moved to battery position, i.e. to closed breech position.

Referring now to FIGS. 7, 9 and 11 the right hand side wall 14 of frame 2 is provided with a shallow recess 56 characterized by a flat recessed surface 58 to accommodate portions of the firing mechanism hereinafter described. Additionally striker-mounting section 12 is formed with a bore 60 (see also FIG. 2) which extends parallel to the axis of barrel mounting section 6 of the frame. At the inner end of the bore the striker mounting section is formed with a smaller cylindrical bore 62 which extends through breech face 52. Slidably mounted in bore 60 is a striker carrier 64. Affixed to carrier 64 so as to be movable therewith is striker pin 66 which is slidably disposed in bore 62. The front end of striker carrier 64 has a flat face 68 and secured in a hole in that face is a small compression-type striker rebound spring 70. The front end of spring 70 engages the flat end face 72 which forms the inner end of bore 60. The overall or combined length of carrier 64 and striker pin 66 is such that when the rear end 72 of carrier 64 is flush with the rear surface 74 of striker-mounting section 12, the front end of pin 66 will be less than flush with breech face 52. Bore 60 is made slightly longer than carrier 64 so that the latter can move forward far enough to cause pin 66 to protrude from breech face 52 far enough to engage a chambered cartridge. Spring 70 (separately and in combination with trigger bar 102 hereinafter described) acts to keep pin 66 from projecting from breech face 52 except when the pistol is fired.

Still referring to FIGS. 7 and 11, a striker actuating pin in the form of a stub shaft 76 is affixed to the side of striker carrier 64 and this shaft carries an actuating roller 78. Shaft 76 and roller 78 extend through an elongated hole 80 in the right hand side wall of the striker-mounting section 12 and protrude beyond recessed surface 58. Hole 80 is long enough to permit the striker assembly to operate in the manner hereinafter described. The forward limit of the striker assembly is determined by engagement of the forward end of carrier 64 with end face 71 of bore 60.

Referring now to FIGS. 7 and 11–14, the right hand side of frame 2 is formed with a cavity 84 and a threaded blind hole 85 at the base of the cavity. Additionally recessed surface 58 is cut away to form a slot 86 which extends between cavity 84 and hole 80 and forms a ledge 88 which is nearly flush with the right hand side surface of striker carrier 64. Cavity 84 is generally circular in shape but has a non-radial extension or tail 90 at about the 10 o'clock position as seen in FIG. 7. Cavity 84 and slot 86 accommodate a coiled striker torsion spring 92. One end of spring 92 projects into and is restrained by the sides of cavity tail 90, while the other end extends along slot 86 and engages striker-actuating pin 76. Spring 92 biases the carrier assembly forward toward breech face 52 but is restrained by engagement of its free end with the curved surface which forms the forward side of slot 86. Spring 92 is held in place by a flat retainer plate 94 which is secured in place by a screw 96 that is screwed into hole 85. A stand-off ring 98 surrounds screw 96 within cavity 84 and acts to prevent plate 94 from being drawn in so far as to bind spring 92 and prevent it from operating in the desired manner. The outer surface of plate 94 is flush with the recessed surface 58; however, a second standoff ring 100 overlies plate 94 and is held in place by the head of screw 96. Ring 100 may be an integral part of plate 96 or a separate member.

Recess 56 accommodates two other members—a trigger bar 102 and a trigger bar torsion spring 104. The latter has its coiled center section loosely surrounding and anchored by a post 106 that forms an integral part of the frame and projects up from surface 58. One end of spring 104 engages a flat shoulder 108 that forms part of the perimeter of recess 56, while its other end engages trigger bar 102 (FIG. 11). The latter is pivotally connected at one end to a trigger unit hereinafter described while its other end is adapted to interact with roller 78 to actuate the striker pin assembly.

Figure 14:
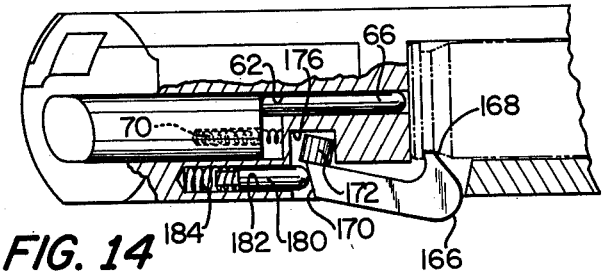
FIG. 14 is a plan view, with certain parts in section, of the striker assembly.
Figure 12:
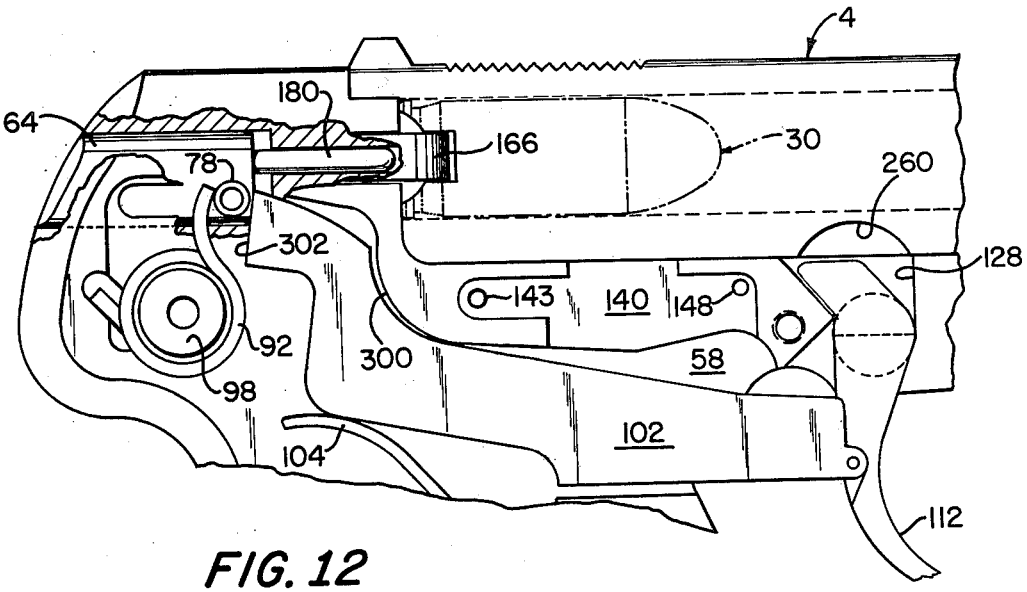
FIG. 12 is a fragmentary view in elevation, partly in section, of the striker assembly.

Referring now to FIGS. 7, 11 and 14, the pistol comprises a one-piece trigger unit which is characterized by a curved trigger 112, a trigger pivot shaft 114 and a tang 116. One side of trigger 112 has a shallow recess 118 to accommodate a finger 110 on the end of trigger bar 102. Finger 110 has a hole which is sized to accept and make a close but rotatable fit with a post 120 which is formed integral with the trigger and serves as a pivot for the trigger bar. Trigger pivot shaft 114 mounts the trigger unit to frame 2, with the latter being formed with a transverse bore 122 that extends through the both sides of the frame and is sized to rotatably accept shaft 114. For this purpose the right side of frame 2 is formed with a slot 124 and a recessed surface 126 to accept the upper end of the trigger so that the base of recess 118 will be flush with recessed surface 58 of the frame and so that the end of trigger bar pivot pin 120 and the right hand side surface of the trigger will not protrude beyond the outer surface of the right hand side of the frame. A second recess in the form of a slot 128 is formed in the right hand side of the frame at its barrel mounting section 6. Slot 128 intersects but is shallower than slot 124 since its purpose is to accommodate tang 116. The trigger unit is urged to its forward position by a trigger return coiled torsion spring 130 which is received in a cavity formed in the right hand side of the trigger unit coaxial with pivot shaft 114. This cavity has a side extension 132 in which one end of spring 130 is anchored. The other end of spring 130 protrudes rearwardly from the trigger and engages an inclined surface 134 which forms one side of slot 124. The right hand side of the trigger unit has a shallow recess 136 to accommodate that end of spring 130 which engages surface 134. Rearward movement of the trigger is limited by engagement of the trigger with a screw 308 which is adjustably secured in the frame. Forward movement of the trigger by spring 130 is limited by engagement of tang 130 with an inclined surface 138 that forms the rear side surface of slot 128.

The pistol also includes a holstering lock. For this purpose the right hand side of frame 2 is provided with still another shallow recess in the form of a slot 140 with somewhat less depth than slot 128. One end of slot 140 has a narrow section to accommodate a small coiled torsion spring 142. The coiled section of spring 142 is anchored by a post 143 (FIG. 7) that is integral with the frame, and one of its ends bears against a shoulder forming one side of slot 140 while its other end bears against a flange 144 which is part of one end of a barrel holstering lock lever 146. The latter is disposed in slot 140 and is flush with the outer surface of the frame. The other end of lock lever 146 has a hole to accommodate a pivot pin 148 which is anchored in a hole in the frame. Lock lever 146 is formed so that the lower portion of its free end forms a sharp corner 150 which can interlock with trigger bar 102. Spring 142 normally holds lever 146 up so that it cannot engage the trigger bar. The latter is formed on its upper edge with an abutment 152 for engagement by corner 150. However, lock lever 146 is disposed so that it cannot be pivoted to place its corner 150 against abutment 152 unless the trigger bar is moved backward (to the left in FIG. 11) by movement of trigger 112. Once this has been done and lever 146 engages with abutment 152, the forward force exerted on trigger bar 102 by roller 78 under the bias of torsion spring 92 causes its abutment to hold lever 146 down despite the upward force exerted by spring 142. The amount of rearward movement of trigger 112 required to permit bar 102 to the interlocked with lever 146 is made sufficient for the trigger unit to lock the barrel against movement relative to the frame, as explained hereinafter. Such locking can only occur when the barrel assembly is in battery position.

Figure 1:
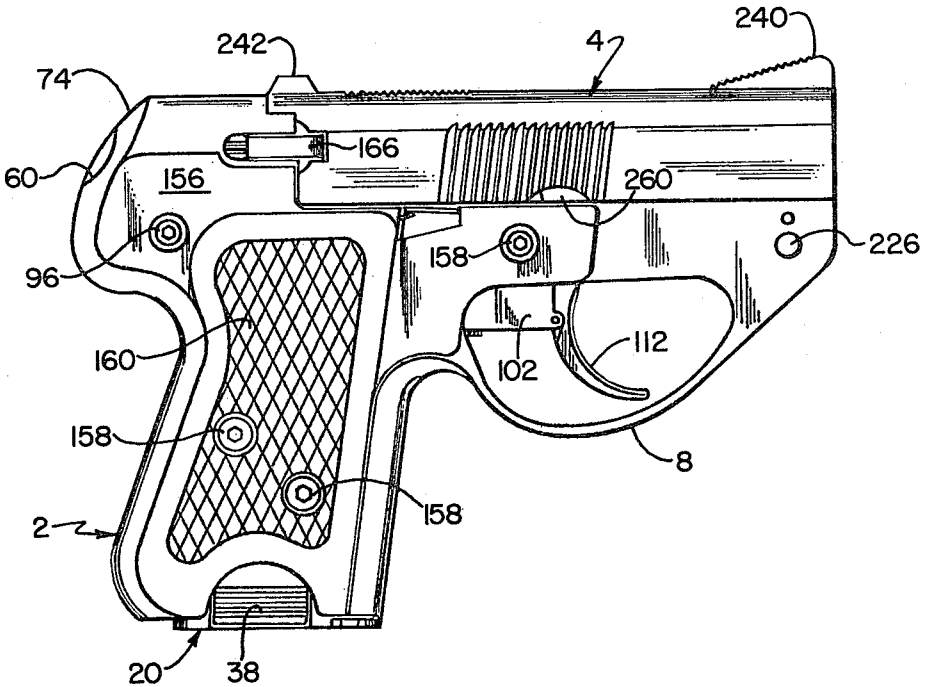
FIG. 1 is a right side elevation of a pistol constituting a preferred embodiment of the invention.

As seen in FIG. 1, a thin side plate 156 is attached to the right hand side of the frame. Plate 156 (FIG. 16) fits flush against the flat outer surface of the frame and is shaped so that it overlies and fully conceals recess 56 and slots 124 and 128. As a consequence it conceals all of the firing mechanism except the forward end of trigger bar 102 and part of the trigger unit and thus holds the firing mechanism in place. Plate 156 is held in place by screw 96 and three screws 158 which are screwed into threaded holes provided in the frame. Standoff ring 100 assures that plate 156 will not be pressed in by screw 96 far enough to interfere with operation of striker spring 92. Right and left hand stocks 160 and 162 of suitable design and material may be attached to the frame. Stock 160 is held in place by screws 158. Stock 162 is held in place by screws 164 that are received by threaded holes in the frame.

Referring again to FIGS. 1, 7 and 11–14, the striker-mounting section also supports extractor means for use in ejecting a spent cartridge case. The extractor means comprises an extractor member 166 which is of rectangular cross-section and is formed with a hook 168 at its forward end. The rear end of extractor 166 is bevelled so as to provide a canted rear surface 170; it also has a pivot arm in the form of a lateral extension 172 at its rear end. The right hand side of a striker-mounting section 12 is provided with a groove 174 of rectangular cross-section for receiving extractor member 166. It also has a cavity 176 at the rear end of groove 174 to receive extension 172. The canted rear surface 170 is engaged by a plunger 180 which is slidably disposed within a blind hole 182 in striker-mounting section 12. A spring 184 in hole 182 urges plunger 180 against surface 170. Cavity 176 is oversized with respect to extension 172 just enough to permit the extractor member to pivot to the position shown in FIG. 14, with the cavity and extension cooperating to provide a loose pivotal connection between the extractor member and the striker-mounting section, while spring-biased plunger 180 urges the extractor member to swing back so that it is fully seated in and aligned with groove 174. Extractor member 166 is made so that when it is fully seated in groove 174, its hook 168 extends in front of breech face 52 but terminates short of striker pin bore 62.

Figure 16:
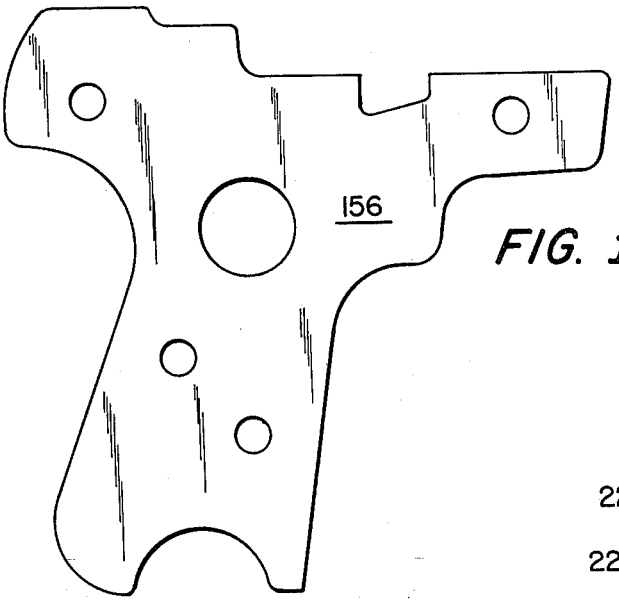
FIG. 16 is a plan view of the cover plate.

Turning now to FIGS. 9 and 16, the right hand side of barrel mounting section 6 is formed with a narrow slot 188 on its upper side for the purpose of receiving a cartridge guide rail 190. The latter is disposed so that it extends above the upper surface of the barrel-mounting section and so that its rear end lies close to tongue 34 of the magazine when the latter is fully inserted into the frame. This same rear end is curved inwardly as shown at 192 in FIGS. 9 and 15. The curved inner end engages the rim of a cartridge which is fed out of the magazine and acts to properly restrain the inertial forward motion of that cartridge so that it cannot enter the chamber, possibly to fall out if the gun is inverted, until the barrel is returned rearward into firing position. Rail 190 is secured in place by the pin 148 which serves as the pivot for lock lever 146.

Figure 2:
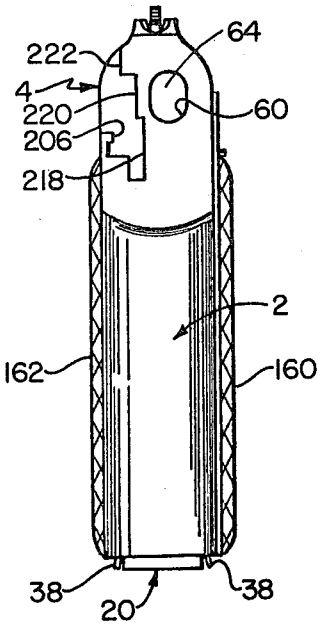
Figure 5:
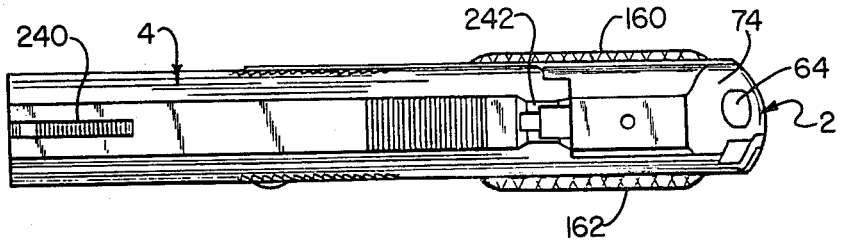
FIGS. 5 and 6 are plan and bottom views of the pistol.
Figure 4:
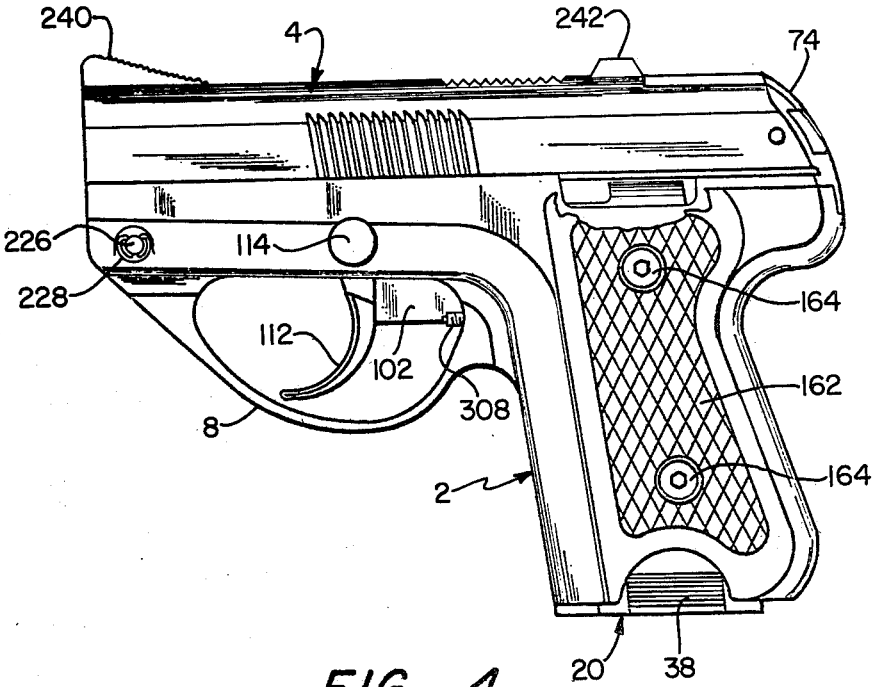
FIG. 4 is a left side elevation.
Figure 6:
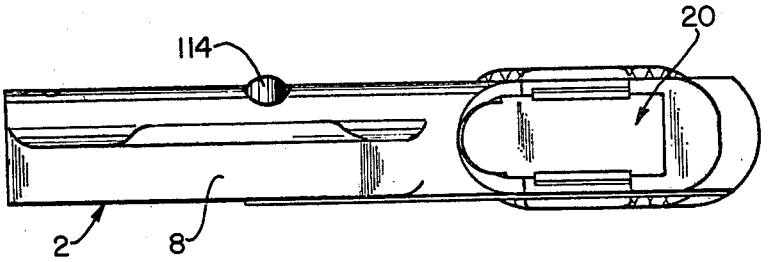
Figure 13:
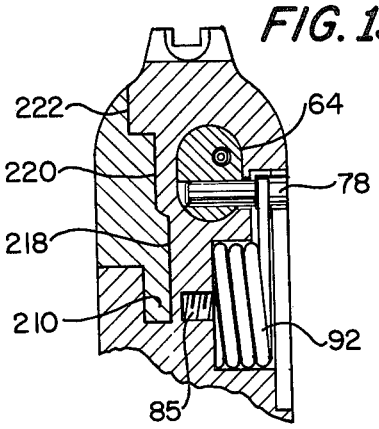
FIG. 13 is a cross-sectional view in elevation of the striker assembly.

FIGS. 2, 3, 7, 8 and 17 show how the frame is adapted to slidably mount the barrel assembly. The barrel-mounting section of the frame is divided into left hand and right hand portions by a longitudinally-extending groove 194 of rectangular cross-section. The right and left hand portions both have flat upper surfaces 196 and 198 respectively, but the left hand portion stands higher. The flat inner surfaces of the right and left hand portions of barrel-mounting section 6 are formed with matching and opposed narrow grooves 200 and 202 respectively of rectangular cross-section. Additionally the left hand portion has a second groove 203 forming a rail 204. The base 215 of groove 194 is intersected by the bore 122 which receives trigger pivot shaft 114. Rail 204 terminates forward of breech face 52, as the result of a slot 208 formed in the left hand side of the frame. However, the frame is provided with a longitudinally extending groove 210 (FIGS. 13 and 17) extending alongside of striker mounting portion 12. Also as shown in FIGS. 2, 8 and 13, the striker mounting portion is undercut so as to form faces 218, 220 and 222. The ledge formed by the intersection of faces 218 and 220 is above the level of rail 204.

Figure 17:
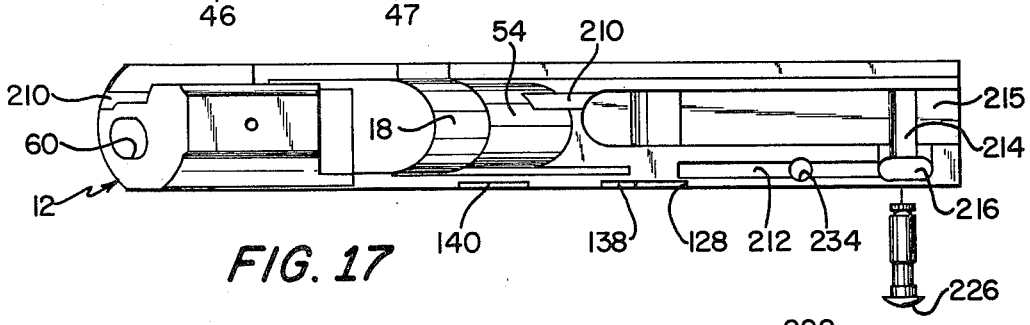
FIG. 17 is a side view of the frame.

Referring to FIG. 17, the upper side of the right hand portion of the barrel mounting section of the frame is also provided with an elongate slot 212. Additionally, the frame is formed with a transverse bore 214 which intersects slot 212 and forms a groove of semicircular shape in the base 215 of groove 194. The forward end of the right hand portion of the barrel mounting section also is formed with a cavity 216 which intersects bore 214.

Slot 212 and cavity 216 are provided to permit the installation of a barrel detent 224 (FIG. 11) which is in the form of a lever that is pivotally mounted by means of a barrel limit pin 226 which is inserted in the transverse bore 214 and is locked in place on the left hand side of the frame by means of a snap ring 228 and also by the reaction force of detent spring 232 which acts to press detent member 224 against the grooved portion of the pin. Detent member 224 is formed with a rounded projection 230 at its free end and is biased upwardly by means of a compression spring 232 which is disposed in a vertically extending cavity 234 (FIG. 17) which intersects and extends below the base of slot 212.

Referring now to FIGS. 1–6, 18 and 19, barrel assembly 4 comprises a one-piece barrel unit which includes a barrel 239 provided with fore and aft cooperating sight members 240 and 242, a narrow depending and longitudinally extending guide section 244 which is formed with a pair of like-shaped rails 246 and 247 on opposite sides thereof, and a rear extension 274. Barrel 239 is formed with an additional groove 249 so as to provide a narrow rail 250 on its left hand side. Rail 250 extends for the full length of the barrel assembly. Rails 246 and 247 extend for the full length of guide section 244, but the latter extends through only a portion of the length of the barrel. Guide section 244 is formed with two depending lugs 252 and 254 at the front and rear ends thereof. The underside of the body of barrel 239 is also formed with a small circularly curved cavity 256 on its right hand side. Rearwardly of cavity 256 the underside of the barrel is formed with a longitudinally extending groove 258. At the forward end of the groove the side of the barrel is formed with a circularly curved slot 260.

As seen in FIGS. 2 and 3, the guide section 244 of the barrel assembly is sized to fit within the groove 194 of the frame, with rails 246 and 247 riding in grooves 200 and 202 and rail 250 riding in the groove 203 on the left hand side of the frame.

Figure 19:
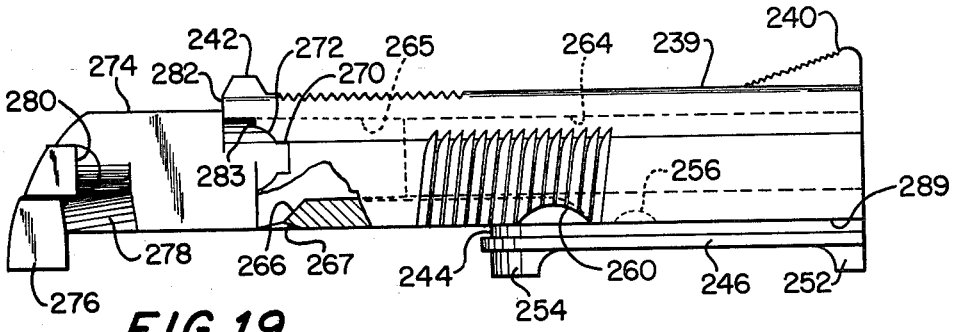
FIGS. 18 and 19 are bottom and side views of the barrel assembly.
Figure 18:
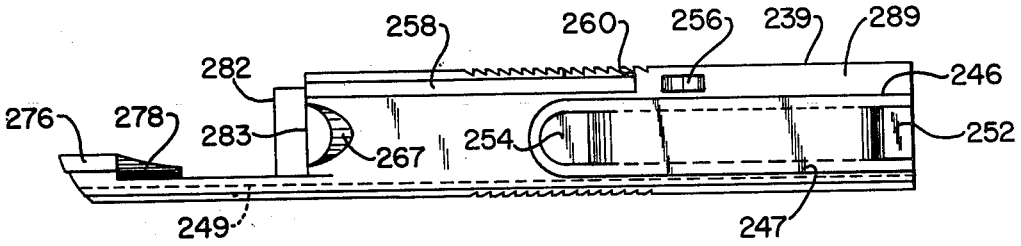

Still referring to FIGS. 18 and 19, barrel 239 is formed with a longitudinally extending bore 264 which is sized according to the caliber of the cartridge for which is piston is designed. The rear end bore 264 constitutes a chamber section for receiving the case of a cartridge to be fired. This section is tapered as shown at 265 so as to facilitate insertion of a cartridge. The rear end of chamber section 265 is formed with a ramp 266 which has substantially the same angle as ramp 54 in the frame. Ramp 266 is curved to accommodate the cylindrical shape of the nose of a cartridge. A bevel 267 is also formed on the underside of the barrel 239. In practice the rear end of a chambered cartridge is flush with a shoulder 283 on barrel 239. The right hand side of barrel 239 is cut away so as to provide a slot consisting of a rectangular section 270 and a flared circularly curved section 272. This slot is provided to facilitate ejection of the case of a spent cartridge.

Figure 20:
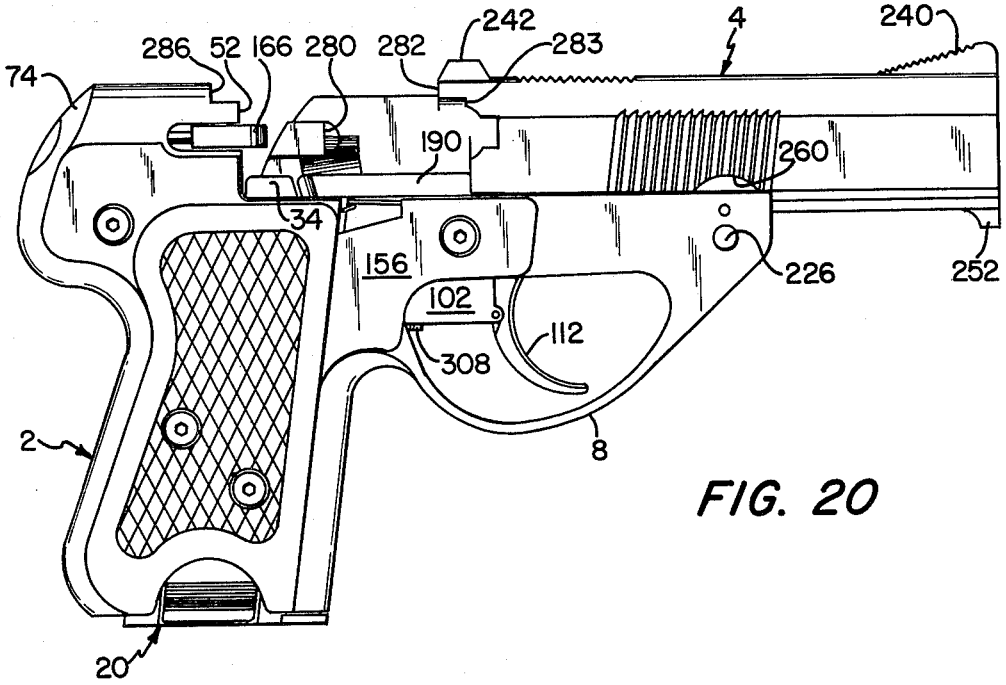
FIG. 20 is a side view in elevation showing the barrel assembly in extended cartridge ejecting position.

Referring to FIGS. 9, 18 and 20, the rear extension 274 is formed on the left hand side of the barrel assembly and its inner surface is flat and disposed so that it can ride against the flat surface 222 of the frame. The rear end of the extension 274 is formed with a depending tail 276 which has flat inner and outer sides and has a thickness so that it will make a close sliding fit in groove 210. Additionally rear extension 274 is formed with a curved surface 278 which, as seen in FIG. 19, slopes away from the flat inner surface of extension 274. Immediately above curved surface 278 the extension is formed with a vertically extending flat abutment 280.

Referring now to FIGS. 1–6, 9, 11, 12 and 18–20, the barrel assembly is slidably attached to the frame with the grooves and rails of the frame interlocking with the rails and grooves of the barrel assembly, whereby the barrel assembly may be reciprocated lengthwise relative to the frame. The frame and barrel are sized so that when the rear face 282 of the barrel assembly engages a vertical surface 286 of the frame, the breech is closed and the front end surface of the frame will be flush with the front end surface of the barrel and the rectangular slot 270 in the side of the barrel will be occupied by the forward hook-shaped portion of extractor member 166. Additionally the tail 276 will be at the rear end of groove 210. Forward and rearward movement of the barrel relative to the frame is limited by pivot pin 226 of barrel detent 224. In this connection it is to be noted that pin 226 is inserted after the barrel assembly has been mounted to the frame and moved rearwardly far enough to place lugs 252 and 254 on opposite sides of bore 214. With pin 226 in place, the barrel can advance only far enough for lug 254 to engage pin 226. Rearward movement of the barrel is limited by engagement of shoulder 283 on the barrel with breech face 52. This latter engagement occurs when the barrel end surface 282 engages or lies close to the end surface 286 of the frame.

Barrel detent 224 is provided for the purpose of holding the barrel in its rearward on battery position. When the barrel assembly is mounted to the frame and moved to the position shown in FIG. 11, detent member 224 is depressed by the flat side under-surface 289 of the body of the barrel member until cavity 256 reaches rounded projection 230, whereupon that end of the detent is pushed upward by spring 252 into cavity 256 to hold the barrel against movement relative to the frame.

Referring to FIGS. 9 and 15, when the pistol is fired, the barrel assembly is locked in battery position by means of a tumbler action provided by the pivot shaft 114 of the trigger unit. Shaft 114 is slotted intermediate its ends so as to form a flat diametrically-extending surface 290. When the trigger is in its forward position, flat surface 290 is flush with the base 215 of groove 194. However, as soon as the trigger is pulled rearwardly, flat surface 290 rotates so that it is inclined to the horizontal and projects above the base 215 of groove 194 in position to intercept rear lug 254 of the barrel assembly. As a consequence, the barrel cannot be moved forward as the weapon is being fired. This same locking action occurs when corner 150 of lever 146 engages the shoulder 152 of trigger bar 102 and holds the latter back. Lever 146 is placed in locking position when the piston is holstered, and its purpose is to assist the detent in assuring that the barrel cannot be pulled out of battery position in the event the barrel catches on the holster or some other thing when the pistol is withdrawn from the holster. Tang 116 is aligned with slot 260 when the barrel is in battery position, with the result that the trigger can be retracted to fire the weapon. The entry of tang 116 into slot 260 provides further assurance that the barrel cannot move forward when the weapon is being fired. However, when the barrel is moved forward out of battery position, slot 260 moves forward away from tank 116, with the result that the tang is blocked by the undersurface 289 of the barrel and this assures that the trigger cannot be pulled to fire the weapon until the barrel is moved back to battery position. The groove 258 in the underside of the barrel slidably accommodates guide rail 190 so that the latter will not interfere with movement of the barrel assembly.

Operation of the weapon will now be described commencing with the assumption that no cartridges are present in the chamber. First magazine 20 containing a selected number of cartridges is inserted into the grip section far enough for the tongues 36 to be interlocked with the catch portions 34 and 37 of the frame. At this point, the uppermost cartridge in the magazine is disposed rearwardly and above the bottom end of ramp 54.

To load the chamber, the barrel assembly is moved forward far enough for lug 254 to engage pivot pin 226, and then the barrel assembly is moved rearwardly again to battery position. On the forward stroke of the barrel assembly, the tail 276 passes through a narrow slot 27 in the upper end of the rear wall of the magazine and engages the rear surface of the upper cartridge in the magazine and forces it forwardly out from between the lips 32 and toward ramp 54. As the barrel continues to move forward (FIG. 20), tail 276 forces the cartridge along ramp 54 far enough to release it from the magazine and cause it to be raised by pressure plate 26 and ramp 54 up between surface 278 of rear extension 274 of the barrel assembly and tab 34 and guide rail 190. The cartridge is moved forward far enough for the inturned portion 192 of guide rail 190 to enter the ejector groove of the cartridge and engage the rim on the rear end of the cartridge. This stops the cartridge and this occurs as the barrel reaches its forward position. At this point the nose of the cartridge is spaced from ramp 266 and the barrel. When the barrel is returned to battery position, the nose of the cartridge which has been freed from the magazine is engaged by ramp 266 and this action forces it up out from between guide rail 190 and extension surface 278. As the barrel moves rearwardly the freed cartridge cams the extractor member 166 laterally far enough for the rim of the cartridge to pass hook 168, whereupon the extractor member moves inwardly again to place hook 168 in engagement with the front end of the cartridge rim, as shown in FIG. 14. At this point the cartridge is fully chambered and is held in place by extractor member 166. If now the barrel were to be moved forward again without firing the weapon, the unfired cartridge would automatically be ejected from the weapon. This is achieved by coaction of slot 272 on the right hand side of the barrel extractor member 166, and abutment 280. As slot 272 moves forward of the nose of the cartridge, the abutment 280 exerts a forward force on the rear end of the cartridge, causing the latter to pivot about hook 168, whereby the nose of the cartridge moves outwardly past the slot 272 and is ejected by the continuing forward pressure exerted by abutment 280. The same ejecting action occurs with a spent cartridge case. In either situation, as the cartridge or spent case is ejected the next cartridge is pulled into position for chambering by operation of the tail 276 in the manner previously described. Chambering of this cartridge occurs on the return stroke of the barrel as previously described.

Operation of the firing mechanism will now be described with reference to FIG. 11. When the trigger is held in its forward position by spring 130, trigger bar 102 is held by spring 104 against the curved edge surface 300 which forms part of the perimeter of recess 56 and the flat rear end surface 302 of the trigger bar is nearly in engagement with roller 78 of the striker assembly, with the latter being restrained against spring 92 by rebound spring 70. When the trigger is pulled to fire the pistol, trigger bar 102 moves rearwardly and also upwardly at the trigger end due to the arc described by pivot pin 120. Since the curved center surface 306 of the trigger bar bears on the radiused surface 300 approximately midway between the trigger and the striker assembly, the trigger bar functions as a first class lever pivoted at its center. Therefore, the striker end has to move downward as well as rearward as the trigger bar moves rearward under the force exerted by the trigger motion. The rearward movement of the trigger bar causes its end surface 302 to act on roller 78 to cause the striker assembly to overcome the force of spring 92 and move back. Since the striker end of trigger bar 102 is moving down at the same time as it is moving rearwardly, at some point in its motion the rear end of the trigger bar will slip off of roller 28. This releases the striker assembly so that it can be propelled forward by spring 92 to fire the weapon. Thereafter when the trigger is released in preparation for the next round, the trigger bar moves forward until spring 104 pops it back up into engagement with the striker roller 78, whereby the trigger bar is ready again to fire the round. When the trigger bar releases the striker assembly, as described, the striker moves forward far enough for its striker pin 66 to ignite the chambered cartridge. As previously noted the upper end of striker spring 92 is limited as to how far it can move forward as a result of its being intercepted by the forward edge of slot 86. Hence when the weapon is fired and torsion spring 92 drives the striker assembly forward, inertia keeps the striker assembly moving forward to penetrate breech face 152 even after the spring 92 is intercepted by the forward edge of slot 86. Thereafter rebound spring 70 urges the striker assembly backward far enough for roller 70 to be reengaged by spring 92, and when the roller is in this position, trigger bar 102 has room to be moved by spring 104 back into the position of FIG. 11 where it serves to block forward motion of the striker.

Set screw 308 may be replaced by a hollow set screw containing a spring-biased plunger which is disposed in position to be engaged and forced back into the set screw by the trigger. This plunger provides added resistance to movement of the trigger and serves as a "feeler" to indicate when the trigger is just short of the point at which the gun will fire.

The above-described pistol has a number of advantages. For one thing, it is compact and lightweight. In a 0.45 model, the pistol has a weight of about 21 ounces and measures about 0.93" wide through the stocks (if the stocks are used) and about 0.75" wide through the barrel or frame, with an overall height of about 3-23/32" and an overall length of about 5-7/32". It does not require a recoil spring, and is ideal for use with a silencer since the latter must be attached to the barrel and the latter is locked closed at all times during firing, which prevents gas leakage and avoids mechanical clatter. The weapon also has two safety features. One is that the firing pin is always non-protruding from breech face 52 due to rebound spring 70 and the restraint imposed on spring 92 by the side of slot 86. So in the static-position of the pistol, the pin 66 does not touch the primer of the chambered cartridge. The second safety feature is that trigger bar 102 holds the striker back to prevent accidental firing should be weapon be dropped. Other safety features are the barrel restraining tumbler action of the trigger unit and the trigger lock provided by tang 116 when the barrel is out of battery position.

Another advantage of the invention is that the weapon is highly accurate since (1) the sights are integral with the barrel and (2) the barrel length is relatively long in relation to the overall length of the weapon. The weapon also is relatively comfortable to fire because of (1) the low placement of the barrel with respect to the shooter's hand, which reduces nuzzle jump, and (2) the high backstrap arch and the narrow section of the handle, both of which are possible because of the use of torsion spring 92 to propel the striker assembly. It is to be noted also that the weapon is provided with serrations on the top as well as on the sides of the barrel (see FIGS. 1, 4, 5, 11, 12 and 18–20) for gripping the barrel. The serrations on top allow the barrel to be reciprocated by the thumb of the non-firing hand of the shooter, so that the barrel may be moved by the shooter for rapid cycling of the weapon without any change in the shooter's firing stance.

Notwithstanding the advantages of the design herein described, the weapon may be modified to operate semi-automatically be adding a recoil spring to return the barrel to battery position and means for propelling the barrel forward on firing to eject the spent case and feed a new cartridge out of the magazine. Such means may comprise means for directing gases so that they discharge against flat surfaces at the front of the barrel to effect opening of the breech, or a relatively deep rifling in the front end of the barrel to cause the moving bullet to frictionally drive the barrel forward. Another approach is to divide the barrel into a front male section and a back female section which are in telescoping relation to one another, with the chamber being in the back section and the rifling in the front section, and the front section being adapted to be driven forward away from the stationery back section by expanding gases (acting against the telescoping back end of the front section) when the weapon is fired, and the rear section being locked against the breech face (by the expanding cartridge case acting on the chamber wall) until after the front section has moved forward a predetermined distance and the bullet has left the front section, whereupon the back section is pulled forward by a linkage connected to the moving front section to effect ejection and reloading in the manner herein described. Still other modifications will be obvious to persons skilled in the art.

I claim:

1. A manually cycled repeating pistol comprising a frame with a handle, a barrel slidably mounted to the frame so as to be movable lengthwise from a first position in which a cartridge is positioned for firing and a second position in which a cartridge can be ejected from the pistol, a firing mechanism carried by the frame independently of the barrel for firing a cartridge when the barrel is in its first position, said firing mechanism comprising a trigger pivotally mounted to the frame and movable from a forward non-firing position to a rear firing position, and locking means operable by said trigger for locking said barrel in said first position when said trigger is moved out of said forward non-firing position, said locking means comprising a pivot shaft for said trigger, and first and second means carried by said barrel and said pivot shaft respectively for interlocking with one another and thereby locking said barrel in said first position when said trigger is moved out of said forward non-firing position.

2. A pistol according to claim 1 wherein said pivot shaft is slotted so as to provide a recessed surface and said barrel has a depending lug, and further wherein said surface is arranged so as to (a) intercept said lug and stop movement of said barrel relative to said frame when said trigger is moved out of said forward non-firing position and (b) clear said lug and thereby free said barrel for movement relative to said frame when said trigger is in its forward non-firing position.

3. A pistol comprising a frame with a handle, a barrel slidably mounted on the upper side of said frame and movable from a rear position in which a cartridge is positioned for firing and a forward position in which a cartridge can be ejected from the pistol, a firing mechanism carried by the frame, means for locking said barrel to said frame, a cavity in said frame for accommodating a cartridge magazine, a ramp in said frame at the top of said cavity for aligning a cartridge released from said magazine so that said cartridge will enter said chamber when said barrel is moved back to battery position, means for directing a cartridge released from said magazine into the chamber of the barrel as the barrel is moved rearwardly to battery position, an extension carried by the rear end of said barrel, a tail carried by said extension for engaging a cartridge in the magazine and forcing it out of the magazine toward said ramp as the barrel is moved out of battery position, an arrestor carried by said frame adapted to snap into the extractor groove of a cartridge as it is forced out of the magazine toward said ramp by said tail, means defining a breech when the barrel is in its forward position, and an extractor member pivotally attached to said frame for shucking a cartridge out from the breech as the barrel is moved to its forward position.

4. A pistol according to claim 3 wherein said barrel includes means cooperating with said arrestor for stopping a cartridge released from said magazine by said tail as said barrel is moved forward out of battery position.

5. A manually cycled repeating pistol comprising a frame with a handle and an upper side, a barrel exterior of said frame and slidably mounted to said upper side of the frame by a rail-and-groove arrangement so as to be movable from a rear position in which a cartridge is positioned for firing and a forward position in which a cartridge can be ejected from the pistol, a lug depending from said barrel, a firing mechanism carried by the frame independently of the barrel for firing a cartridge when the barrel is in its rear position, said firing mechanism comprising a trigger pivotally mounted to the frame and movable from a forward non-firing position to a rear firing position, and means for locking said barrel to said frame, said locking means comprising means attached to said trigger for engaging said lug and thereby locking said barrel in said rear position when said trigger is moved out of said forward non-firing position.

* * * * *